United States Patent [19]

Moriyama et al.

[11] 3,936,177

[45] Feb. 3, 1976

[54] ELECTROSTATIC COPYING MACHINE

[75] Inventors: Inao Moriyama, Ebina; Yujiro Ando, Yokohama; Katsunobu Ohara; Keiji Tanaka, both of Kawasaki, all of Japan

[73] Assignee: Canon Kabushiki Kaisha, Tokyo, Japan

[22] Filed: July 11, 1974

[21] Appl. No.: 487,740

[30] Foreign Application Priority Data

July 17, 1973 Japan ..... 48-81335

[52] U.S. Cl. ..... 355/4; 355/3 R; 96/1.2; 271/193; 317/262 E; 226/94

[51] Int. Cl.[2] ..... G03G 15/01; G03G 15/18; B65H 29/30; G65H 17/28

[58] Field of Search ..... 355/3 R, 4, 16, 3 SC; 96/1.2; 271/193, DIG. 3; 317/262 E; 226/94

[56] References Cited

UNITED STATES PATENTS

| | | | |
|---|---|---|---|
| 3,220,324 | 11/1965 | Snelling | 355/16 |
| 3,645,614 | 2/1972 | McFarlane et al. | 355/3 R |
| 3,680,954 | 8/1972 | Frank | 355/3 R |
| 3,761,173 | 9/1973 | Fotland et al. | 355/3 R |
| 3,832,053 | 8/1974 | Goel et al. | 355/3 R |

*Primary Examiner*—Robert P. Greiner

*Attorney, Agent, or Firm*—Fitzpatrick, Cella, Harper & Scinto

[57] ABSTRACT

An electrostatic copying machine comprises a photosensitive screen having a number of fine openings therein, means for forming on the screen a primary electrostatic latent image corresponsing to an original image, an electrostatic attracting device for electrostatically attracting a recording material and moving said recording material in facing relationship with the surface of the screen on which the latent image is formed, a device for supplying the recording material to the electrostatic attracting device, and means for forming a secondary electrostatic latent image on the recording material conveyed by the attracting device.

22 Claims, 22 Drawing Figures

ELECTROSTATIC COPYING MACHINE

BACKGROUND OF THE INVENTION

1. Field of the Invention

This invention relates to an electrostatic copying machine which uses a photosensitive screen having a number of fine openings therein.

2. Description of the Prior Art

As the typical conventional electrophotography, a direct process such as for example electrofax and an indirect process such as xerography are presented. In the former direct process, use is made of a specifically treated recording material coated with a photoconductive material such as zinc oxide. Consequently, there is a drawback in the image contrast as the image formed on the recording material lacks brightness. Moreover, due to the specific treatment, the recording material is heavier than the conventional paper and has a different feed from the usual paper. According to the latter indirect process, a high contrast and high quality image is obtained since it uses plain paper as the recording material to form an image. However, in this indirect process, when a toner image is transferred to the recording material, the recording material contacts with the surface of the photosensitive member and further, cleaning means strongly contacts with the surface of the photosensitive member when the remaining toner is removed, so that the photosensitive member undergoes a deteriorating each time the transfer and the cleaning is effected. Therefore, the durability of an expensive photosensitive member is reduced and this results in a high cost for the image formation.

The improvements for eliminating the above-described drawbacks of the conventional process were disclosed in, for example, U.S. Pat. Nos. 3,220,324; 3,680,954 and 3,645,614. In these patents, a photosensitive member of the screen type or the grid type is used which has a number of fine mesh-like openings. The electrostatic latent image is formed on a recording material by modifying ion flow through the screen or grid, and thereafter the recording material with the latent image formed thereon is visualized. There is no necessity of developing and cleaning the screen or grid which corresponds to the photosensitive member, so that the durability of the screen or grid is increased.

In U.S. Pat. No. 3,220,324, a conductive screen coated with a photoconductive material is used and corona ions from a corona discharger and an image exposure applied simultaneously to a recording material through said screen. The corona ion flow is modified by the screen and an electrostatic latent image is formed on the recording member.

According to U.S. Pat. No. 3,680,954, a conductive grid coated with a photoconductive material and a conductive controlling grid are used, an electrostatic latent image is formed on the grid in the image form, and different electric fields are formed on the grid and the controlling grid so as to modify the corona ion flow to form an image on a recording member.

In U.S. Pat. No. 3,645,614, the screen comprises an insulating material overlaid with a conductive material and the insulating material comprises a photoconductive material. An electric field preventing the passage of ion flow is formed at the openings for passing the ion flow due to the electrostatic latent image formed on the screen.

In an image forming apparatus using the above-described screen having a number of fine openings therein, a sheet-like recording material such as insulating paper or the like on which an image is to be formed by modulated ions must be positioned closely adjacent the primary electrostatic latent image on the screen in order to provide a good copy image. For this purpose, a device has heretofore been considered which moves a flat or a drum-shaped screen relative to a recording material being conveyed by a stationary conveyor means so that the primary electrostatic latent image on the screen may be positioned closely adjacent the recording material. However, movement of the screen has raised difficulties in obtaining a mechanical accuracy of the device and also led to a larger size of the device.

SUMMARY OF THE INVENTION

The present invention provides an electrostatic copying machine in which the ion flow as described above is modulated to form a copy image.

It is a primary object of the present invention to enable copy paper to be fed to a photosensitive screen with ease and reliability and accuracy.

It is another object of the present invention to form a good electrostatic latent image on copy paper through the above-described reliable and accurate feed of copy paper.

It is still another object of the present invention to produce clear copies without misregistration of resolved colors when the invention is applied to color copying.

It is yet another object of the present invention to make the entire construction of the copying apparatus simpler and more compact.

Other objects and advantages of the present invention will appear in the following detailed description of some embodiments. The above and other objects will be achieved by these embodiments of the apparatus which will generally be described below.

The apparatus of the present invention is an electrostatic copying apparatus which comprises a photosensitive screen having a number of fine openings therein, primary electrostatic latent image forming means for effecting voltage application and image light application on the screen, an electrostatic attracting device for electrostatically attracting a sheet-like recording material and moving the same in facing relationship with the surface of the screen bearing the latent image, a device for supplying the recording material to the electrostatic attracting device, and means for forming a secondary electrostatic latent image on the recording material conveyed by the electrostatic attracting device. Particularly, when applied to the color copying, the apparatus may further comprise a device provided in the primary electrostatic latent image forming means for projecting an original image upon the screen through color resolving filters, and a device for developing the secondary electrostatic latent image on the recording material conveyed by the electrostatic attracting device, by the use of color developers corresponding to the colors of the color resolving filters used in the projection device, whereby the above-described process means and devices are repetitively operated for each color of the original image to apply each color onto the same recording member, thereby producing a colored copy.

In the present invention, the term "primary electrostatic latent image" means an electrostatic latent image formed on the screen through a predetermined process in accordance with the image of an original to be copied, and the term "secondary electrostatic latent image" means an electrostatic latent image formed on an electrically chargeable recording material, by modulating the ion flow by means of the above-described primary electrostatic latent image. The recording material may be any of a group of material such as insulating paper (paper having a surface treated for insulation), an insulating sheet of polyethylene terephthalate or the like treated for electrical conduction or having an electrically conductive member joined thereto, or a sheet of metal treated for insulation or having an insulating member joined thereto. Although any of these various recording materials is usable with the present invention, the following embodiments will be described with respect only to the cases where insulating paper is used. Such insulating paper will hereinafter be referred to as "copy paper."

DESCRIPTION OF THE PREFERRED EMBODIMENTS

Figure 1:
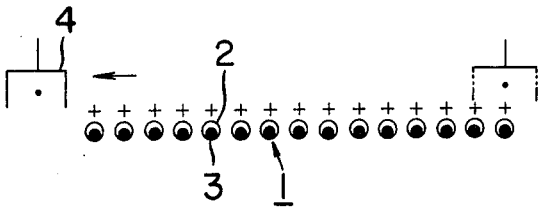
FIGS. 1 to 3 illustrate the manner in which an electrostatic latent image is formed on a photosensitive screen.
Figure 2:
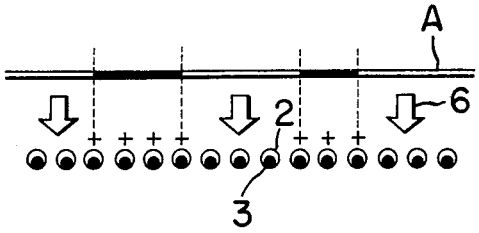
Figure 3:
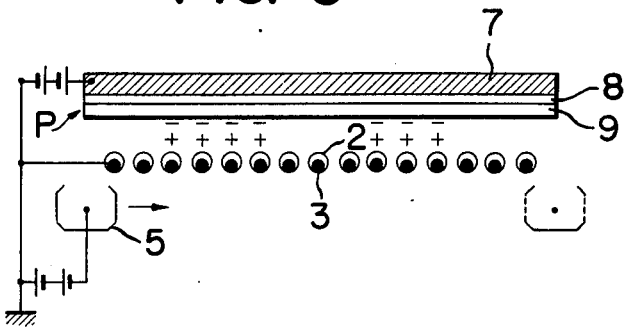

Although the method of the formation of electrostatic latent images utilizing the above-described screen is disclosed in each of the aforesaid U.S. Patents, the process steps involved in such method will generally be described herein with reference to FIGS. 1 to 3.

The surface of a photosensitive screen 1, basically comprising a photoconductive layer 2 and a conductive back-up member 3, is uniformly charged by a corona discharger 4 (FIG. 1). Subsequently, an original image A is projected upon the screen 1 to form a primary electrostatic latent image thereon (FIG. 2). A sheet of copy paper P is disposed in a predetermined spaced-apart and opposed relationship with the latent image and, when the surface of the copy paper is charged by a corona discharger 5 through the screen 1, the charge on the copy paper surface is controlled under the influence of the electric line of force of the electrostatic latent image on the screen 1 so that a secondary electrostatic latent image corresponding to the primary one on the screen 1 is formed on the copy paper surface (FIG. 3). Thereafter, such copy paper may be developed by conventional developing means to provide a copy. Such copying process permits the photosensitive screen to be used for a long period of time without being injured, because the photosensitive screen as the photosensitive medium need not be cleaned and because there is no contact between the photosensitive screen and the copy paper. Also, copy paper used may be of a quality approximate to ordinary paper. These make the advantages. In FIG. 2, arrows 6 indicate the light rays passed through the original A. In FIG. 3, numeral 7 designates an electrode member for attracting the ion flow from the corona discharger 5 to the copy paper P. It will be noted that the copy paper P comprises a back-up member 8 such as paper or the like and an insulating layer 9 provided thereover.

Figure 4:
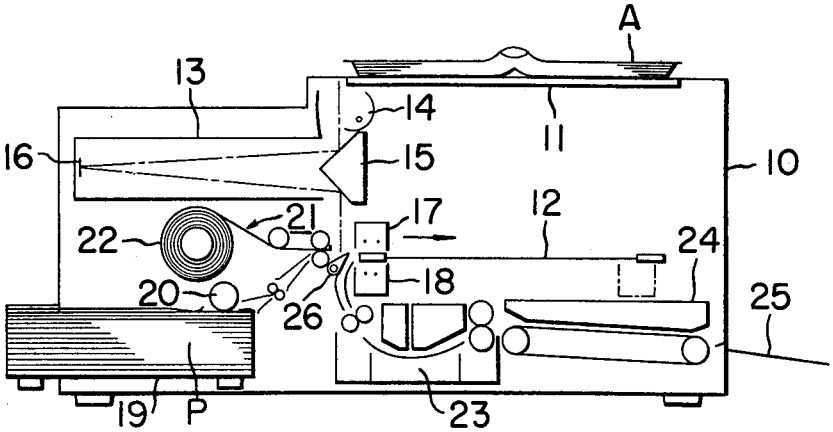
FIGS. 4 and 5 are schematic illustrations of an electrostatic copying machine having the screen as shown in FIG. 1.

FIG. 4 schematically shows a copying machine which includes a machine housing 10, a stationary photosensitive carriage 11 formed of a light-transmitting plate and provided on top of the machine housing, and a flat photosensitive screen 12 of the above-described construction fixedly provided below the original carriage. The machine further includes a movable projecting optical system 13 comprising an original illuminating lamp 14, a prism 15 and an in-prism lens 16, and being movable between the original carriage 11 and the photosensitive screen 12 to project the optical image of the original A upon the photosensitive screen 12, a discharger 17 for the photosensitive screen movably disposed above and along the upper surface of the pehotosensitive screen 12, and a copy paper discharger 18 movably disposed below and along the lower surface of the photosensitive screen 12. The machine also includes a copy paper feed bed 19 (shown as a cassette type) from which sheets of copy paper P may be fed one by one with the aid of a paper fed roller 20.. Designated by 21 is a belt-like electrostatic attracting member which serves to electrostatically attract and hold thereagainst the copy paper P fed from the feed bed 19 and convey the copy paper along the underside of the photosensitive screen 12 to position the plane of the copy paper in a predetermined spaced-apart relationship with the plane of the photosensitive screen. The belt-like electrostatic attracting member 21 is normally wound up under a back-tension from a hoisting member such as hoist reel 22 or the like. The construction of the electrostatic attracting member 21 will be described more specifically hereinafter. There are further provided developing means 23 (shown as liquid developing means), drying-fixing means 24 and copy tray 25.

Figure 5:
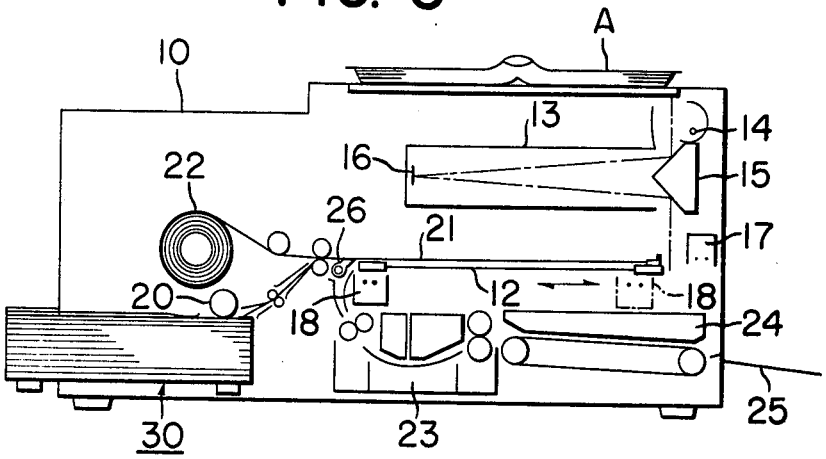

The discharger 17 is moved in the direction of the arrow to uniformly charge the entire upper surface of the photosensitive screen 12, whereafter the optical system 13 is moved to permit the image of the original A on the carriage 11 to be projected upon the photosensitive screen 12, thereby forming a primary electrostatic latent image on the screen 12. Alternatively, the discharger 17 and the optical system 13 may by synchronously moved to effect charging and projection simultaneously. Then, a sheet of copy paper P is fed from the paper feed bed 19 toward the web of the electrostatic attracting member 21 as the latter is drawn out along the upper surface of the photosensitive screen 12 by suitable draw means (not shown) against the back-tension of the hoist reel 22. Thus, the copy paper P fed toward the electrostatic attracting member 21 has its successive portions from the leading to the trailing edge attracted to the web of the attracting member and is conveyed on the attracting member 21 along the upper surface of the photosensitive screen 12. Thus, by having a required length of the electrostatic attracting member 21 drawn out, it is possible to dispose the copy paper P generally in a predetermined spaced-apart, opposed relationship with the surface of the photosensitive screen 12 (FIG. 5). In such position, the discharger 18 for the formation of a secondary electrostatic latent image is moved in the direction of the arrow so that corona discharge opposite in polarity to the electrostatic latent image on the photosensitive medium is applied to the entire surface of the copy paper P through the mesh of the screen 12, whereby a positive latent image corresponding in configuration but opposite in polarity to the electrostatic latent image on the screen 12 is formed on the surface of the copy paper P in accordance with the principle described previously. Then, the electrostatic attracting member 21 is rewound by the back-tension of the reel 22 and during such rewind process, the copy paper P attracted to the electrostatic attracting member 21 has its successive portions from the trailing to the leading edge separated from the attracting member by a separator pawl 26 and is conveyed toward the developing means 23 for developing the latent image to provide a copy. The optical system 13 and the dischargers 17 and 18 are returned to their initial positions in synchronism with the rewind of the electrostatic attracting member 21.

Figure 6:
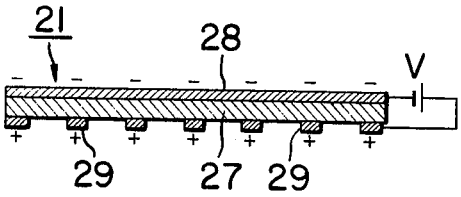
FIGS. 6 and 7 illustrate a form of the electrostatic attracting member.
Figure 7:
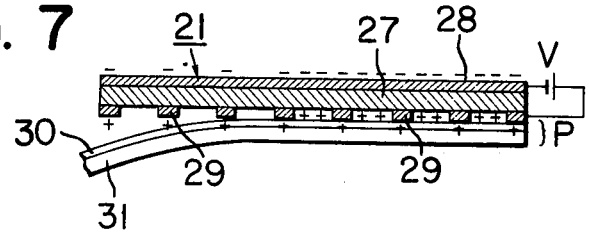

The electrostatic attracting member 21, as shown in FIG. 6, for example, may comprise a high resistance layer 27 such as polyethylene terephthalate film or the like having one entire surface coated with a metal foil or a conductive paint forming a conductive layer 28 and having the opposite surface formed with a conductive layer 29 consisting of substantially equidistant lines (or meshes). A voltage V may be applied between the two conductive layers 28 and 29. When a sheet of copy paper P is brought into contact with the linear conductive layer 29 of the electrostatic attracting member 27 with the voltage V being applied between the two conductive layers 28 and 29, the back-up member 30 forming the back surface of the copy paper will be at a potential equal to that of the linear conductive layer because the copy paper P used for the electrostatic copying method utilizing the above-described screen consists of the conductive back-up member 30 and the insulating layer 31 treated for insulation, and as a result, an amount of charge proportional to the electrostatic capacity between the back-up member 30 of the copy paper P and the conductive layer 28 of the electrostatic attracting member 21 will be induced in the back-up member 30 and the entire conductive layer 28, and an electrostatic attraction proportional to such amount of charge will cause the copy paper P to be attracted to the electrostatic attracting member 21 (FIG. 7).

Figure 8:
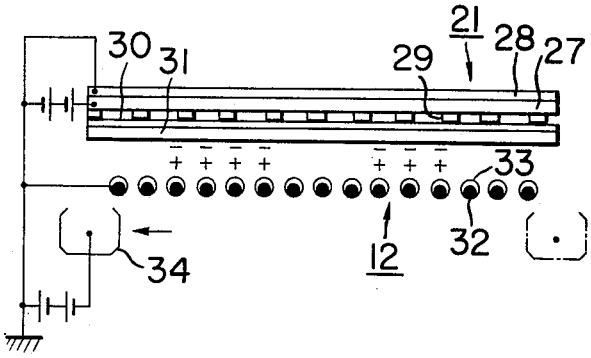
FIG. 8 illustrates the process of forming a secondary electrostatic latent image by using the electrostatic attracting member as shown in FIG. 6.

The lower the electrical resistance of the back-up member 30 of the copy paper P, the higher the above-described attraction effect. The interval between adjacent lines of the conductive layer 29 depends on the resistance of the back-up member 30 and may be increased as the resistance is decreased. For example, the interval may be 1 to 15 mm. Also, the smaller the thickness of the high resistance layer 27, the greater the attraction. For example a thickness of 200 microns for the high resistance layer 27 and the use of polyethylene terephthalate film for such layer will provide a sufficient attraction at a voltage of 1.5 KV. The formation of a secondary electrostatic latent image by the use of a screen must be effected with a bias voltage of the order of 1 to 3 KV being applied to copy paper P, if the conductive back-up member of the screen 12 is grounded, and the electrostatic attracting member 21 may serve also as the electrode for applying such bias voltage (see FIG. 8). In FIG. 8, reference numeral 12 designates the screen, 32 the conductive back-up member, 33 the photoconductive layer and 34 the corona discharger.

Further, if the surface of the high resistance layer 27 exposed between the lines of the linear conductive layer 29 is charged, the attraction effect will be impeded. To prevent this, the material of the high resistance layer 27 must be selected from unchargeable materials or such layer must sometimes be discharged. The discharge means may be the conventional corona discharge or a conductive discharger roller, or during non-charging of the copy paper the discharging may be done by applying to copy paper a voltage opposite in polarity to the voltage required during charging of the copy paper and thereby causing the copy paper to be attracted.

Figure 9:
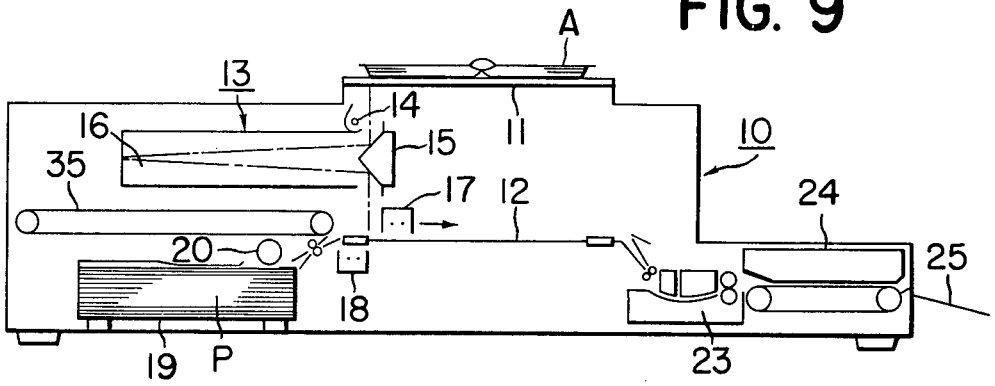
FIGS. 9 and 10 are schematic illustrations of the electrostatic copying machine according to another embodiment of the present invention.
Figure 10:
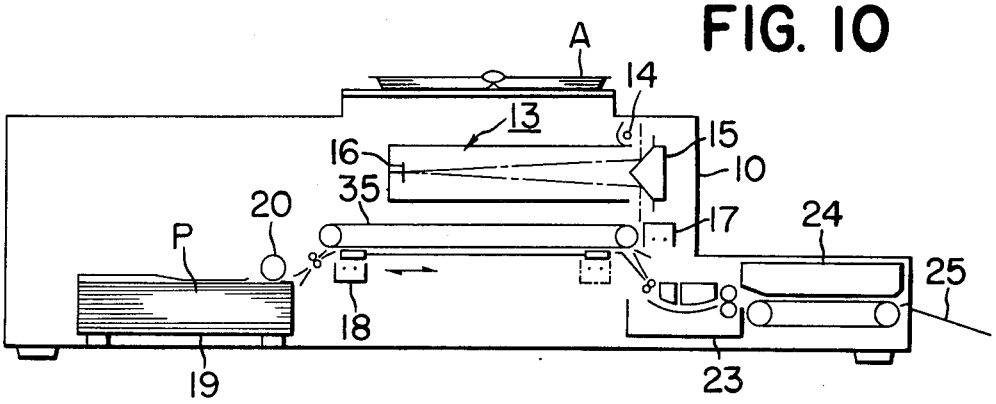
Figure 11:
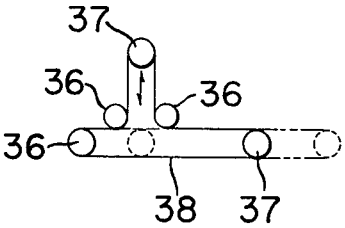
FIGS. 11 and 12 illustrate the arrangement for positioning the electrostatic attracting member with respect to the screen surface.
Figure 12:
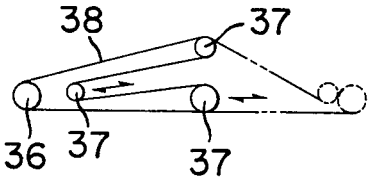

FIGS. 9 and 10 show a modification of the electrostatic copying machine shown in FIGS. 4 and 5 and in which the electrostatic attracting member is in the form of an endless belt. This embodiment is suitable for retention copying wherein after an electrostatic latent image is formed on the photosensitive screen 12, the electrostatic attracting member 35 in the form of an endless belt is displaaced to overlie the photosensitive screen (FIG. 9), and in this position the member 35 is intermittently moved to convey sheets of copy paper P successively into facing relationship with the screen surface, whereby multiple copies may be produced from a single primary electrostatic latent image formed on the screen 12. In such multi-copy production, the photosensitive screen may advantageously be formed of a material which is less subject to attentuation of the formed primary electrostatic latent image. In order to reduce the space occupied by the belt-like attracting member within the copying machine, as shown in FIGS. 11 and 12, a plurality of belt-tensioning stationary rollers 36 and movable rollers 37 may be used so that the belt-like attracting member normally assumes a solid-line position for a reduced space and during copy paper feeding, a portion of the belt may be extended toward the photosensitive screen in the manner as indicated by a line. In FIGS. 11 and 12, the electrostatic attracting member in the form of an endless belt is designated by 38 and the movable rollers 37 are movable in the directions of arrows. In FIG. 9, similar reference numerals are similar in significance to those in FIG. 4.

A photosensitive screen suitable for use in the above-described retention copying is exemplarily shown in FIGS. 13 through 17. By having a primary electrostatic latent image formed on an insulating member as in the screen described hereinafter, there may be formed a secondary electrostatic latent image which is less subject to attenuation.

Figure 13:
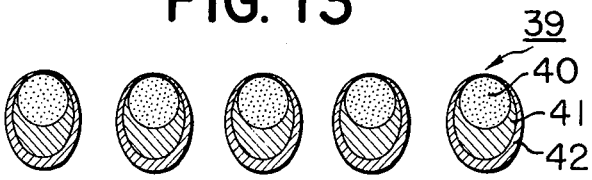
FIGS. 13 to 17 illustrate the manner in which an electrostatic latent image is formed on a photosensitive screen suitable for retention copying.

The photosensitive screen 39 shown in FIG. 13 comprises a conductive member 40 having fine openings therein, and a photoconductive member 41 and an insulating member 42 disposed in layers over the photoconductive member 40 so as to leave a portion of the conductive member 40 exposed.

The conductive member 40 may be prepared by etching a plate of metal such as stainless steel or nickel to form fine openings or by electroplating or by knitting a metal wire. A suitable mesh value of the conductive member 40 for the purpose of copying would be 100 to 400 meshes with the resolving power taken into account. The photoconductive member 41 may be formed by evaporating Se-alloy or like material or by spraying an insulative resin material having particles of CdS, PbO or the like with a dispersion medium applied thereto. The insulating member 42 may be formed by spraying or vacuum-evaporating an organic insulating material such as polyethylene, acrylic resin, silicon resin or the like. The materials and formation of the photosensitive screen may be in accord with the technique in the planar photosensitive medium used in the conventional electrophotography. In order to form the members 41–42 so as to leave a portion of the conductive member 40 exposed, these members 41–42 may be applied to the conductive member 40 from one side thereof or, if the members 41–42 happen to wrap up the conductive member 40, a portion of the members 41–42 may be ground so as to provide an exposed portion of the conductive member 40.

FIGS. 14 to 17 illustrate the steps of process for forming an electrostatic latent image by the use of the above-described photosensitive screen 39. The screen shown there is of such a characteristic that the photoconductive member in the dark region is also injected with holes. In these figures, the photoconductive member 41 is a semiconductor formed of Se having holes as main carrier or of an Se-alloy.

Figure 14:
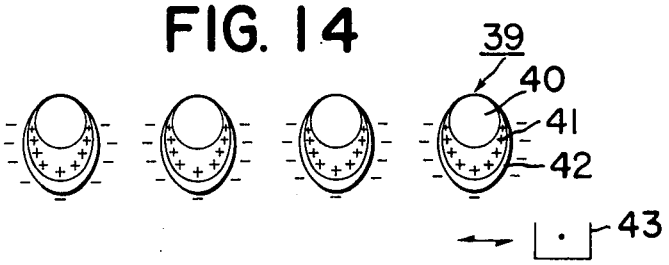

FIG. 14 shows the result obtained by the step of primary voltage application, during which the insulating member 42 is uniformly charged with negative polarity by charger means such as corona discharger 43 or the like. By this charging, holes are injected through the conductive member 40 into the photoconductive member 41 and found in the interface adjacent the insulating member 42.

Figure 15:
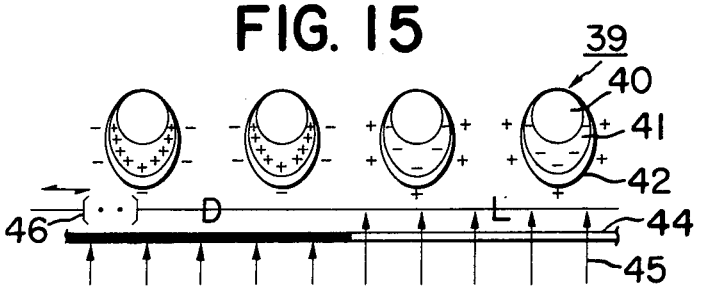

FIG. 15 shows the result obtained when the step of secondary voltage application and the step of image light application are effected simultaneously. The secondary voltage application is effected by corona discharging from a source of voltage comprising an AC voltage with a bias voltage of positive polarity superposed thereupon. By this step, the surface potential of the insulating member 42 becomes positive, but in contrast with the light region of the portion irradiated with the image light, the charge in the surface of the insulating layer in the dark region is of the negative polarity because of the positive charge present in the portion of the photoconductive member 41 which is adjacent the insulating member 42. The voltage to be applied in the step of secndary voltage application is not restricted to an AC voltage but a DC voltage opposite in polarity to the primary voltage is equally usable. Further, if the photoconductive member is of a slow dark-attenuation characteristic, the secondary voltage application and the image light application need not take place simultaneously but may take place in sequence. In FIG. 14, reference numeral 44 designates an original having an original image including a light region L and a dark region D, and reference numerals 45 and 46 designate the light rays and corona discharger, respectively. By these steps, an electrostatic latent image is formed on the screen 39, and the latent image will increase its electrostatic contrast with time or with an overall irrediation to provide a primary electrostatic latent image.

Figure 16:
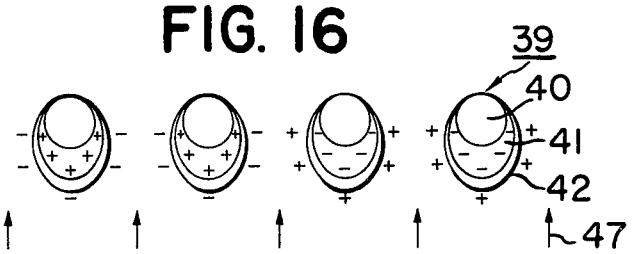

FIG. 16 shows the result obtained by effecting an overall irradiation on the photosensitive screen 39. This overall irradiation does not vary the surface potential of the screen 39 in the light region but causes the surface potential in the dark region to be rapidly varied to a potential proportional to the amount of surface charge of the insulating member 42, thereby forming a primary electrostatic latent image. Reference numeral 47 designates the light rays.

Figure 17:
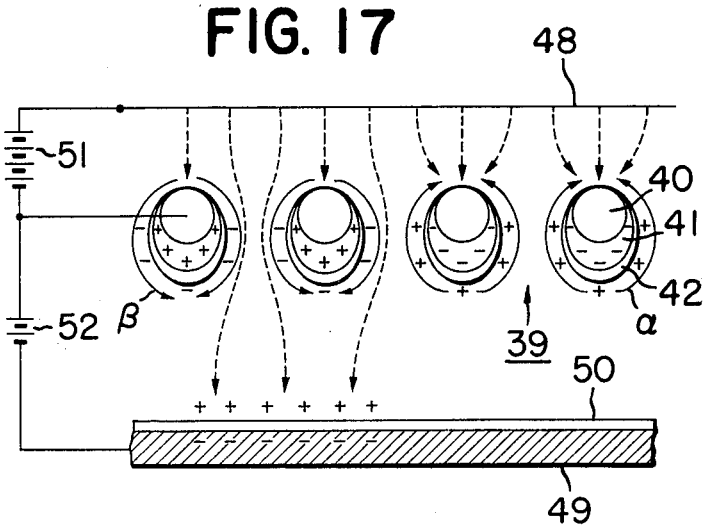

FIG. 17 shows the manner in which the ion flow is modulated by the primary electrostatic latent image on the screen 39 so that a positive image corresponding to the original image is formed by the charge on the recording member. Reference numeral 48 denotes the corona wire of the discharger, 49 an electrode member, 50 a sheet of copy paper capable of retaining a charge, and 51–52 voltage sources. The copy paper 50 is disposed on the side of the screen 39 which is adjacent the insulating member 42, while the wire 48 is disposed on the opposite side of the screen 39 at which the conductive member 40 is exposed. The corona ion flow from the wire 48 is applied to the copy paper 50 by utilizing the potential difference between the wire 48 and the electrode member 49. When this occurs, electric fields as indicated by solid lines $\alpha$ are created in the light region of the screen by the charge forming the primary electrostatic latent image. Thereby, the ion flow as indicated by the broken line is prevented from passing through the screen and thus, flows into the exposed conductive member 40. On the other hand, in the dark region of the screen 39, electric fields as indicated by solid lines $\beta$ are created and the ion flow reaches the surface of the copy paper 50 irrespective of the fact that the ion flow is opposite in polarity to the primary electrostatic latent image. Since the primary electrostatic latent image is formed on the insulating member 42 as described above, the electrostatic contrast can be highly increased by the amount of charge. Further, since the attenuation of the formed charge can be minimized, it is possible to use the same primary electrostatic latent image to provide a secondary electrostatic latent image multiple times, and this makes it possible to achieve the retention copying wherein multiple copies are provided from a single primary electrostatic latent image.

Figure 18:
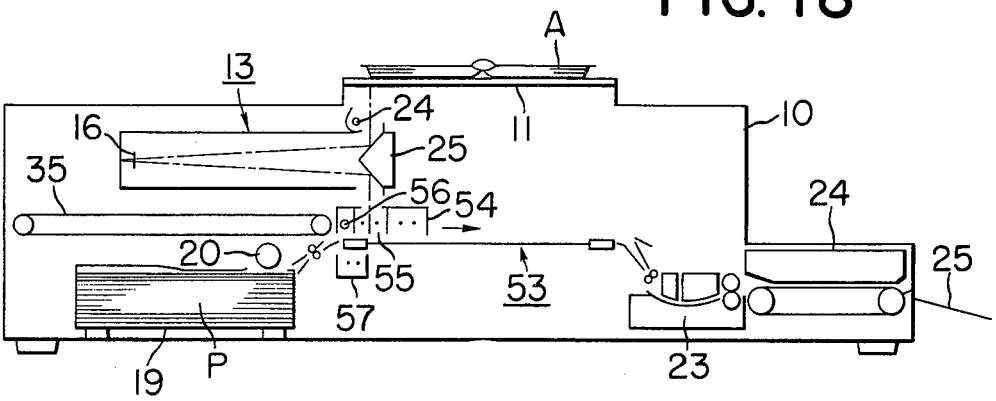
FIGS. 18 and 19 are schematic illustrations of an electrostatic copying machine using the screen as shown in FIG. 13.
Figure 19:
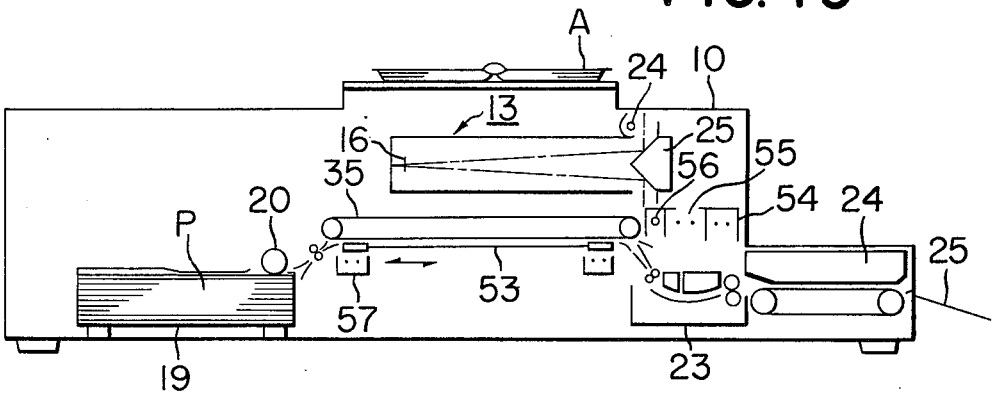

FIGS. 18 and 19 show the screen of FIG. 13 as used with the apparatus of FIG. 9. In these figures, reference numeral 53 designates the screen whose construction is shown in FIG. 13, and this screen is disposed with the exposed conductive member facing downwardly. Reference numeral 54 denotes a corona discharger for effecting primary voltage application, 55 a corona discharger for effecting secondary voltage application simultaneously with image light application, and 56 an overall illuminating lamp. Further, reference numeral 57 designates a corona discharger for the formation of secondary electrostatic latent image. FIG. 19 shows the manner in which a secondary electrostatic latent image is formed. The operational principle of the apparatus is identical with that described with respect to FIGS. 9 and 10, except that during the primary electrostatic latent image formation the corona discharges 54, 55 and lamp 56 are moved to the vicinity of the screen in synchronism with the optical system 13.

Figure 20:
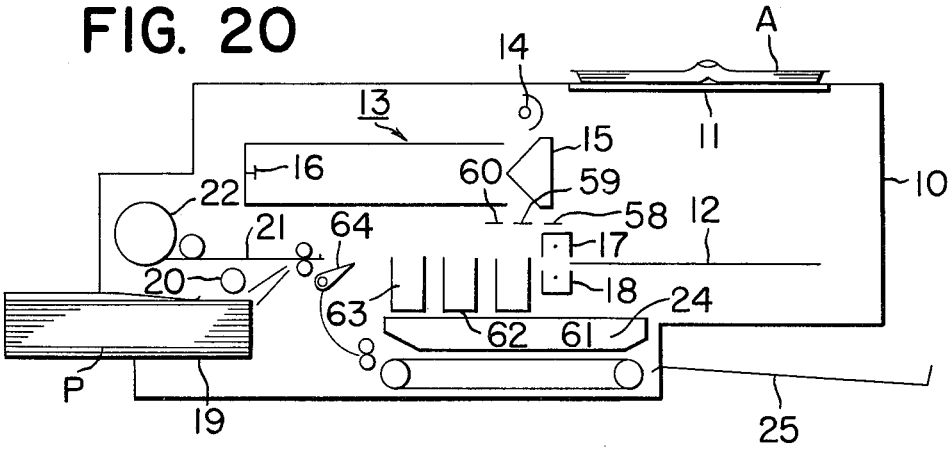
FIGS. 20 to 22 schematically illustrate the construction of an electrostatic copying apparatus for producing colored copies.
Figure 21:
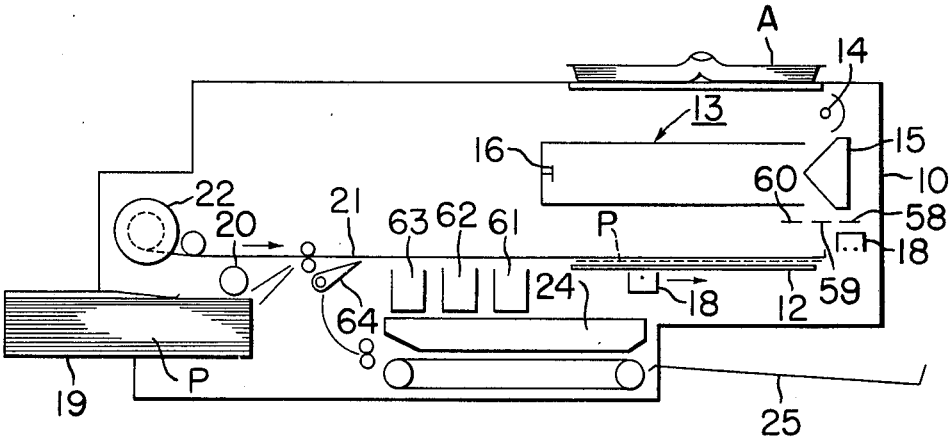
Figure 22:
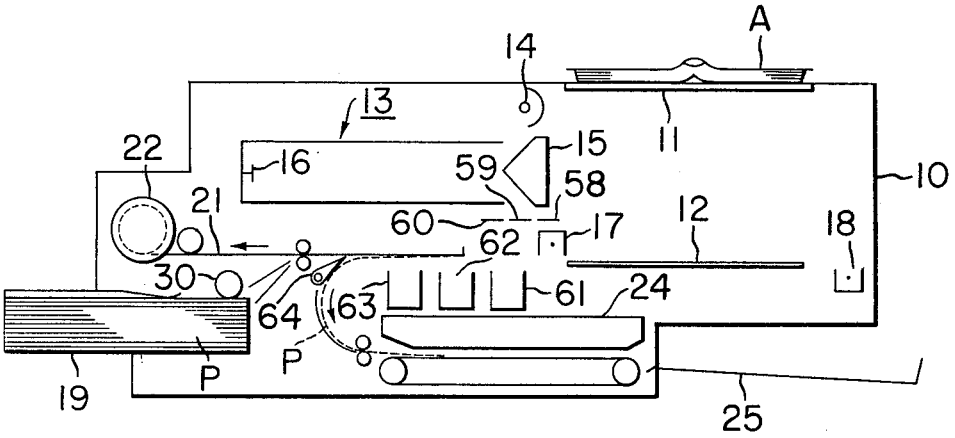

The electrostatic copying machine shown in FIGS. 20–22 is an example of the apparatus of FIG. 4 as applied to a color copying machine. This machine differs from the copying machine of FIGS. 4–5 in that the projecting optical system 13 including the lamp 14, prism 15 and in-prism lens 16 is provided with change-over type color resolving filters 58, 59, 60 and that a plurality of developing means 61, 62, 63 is provided for effecting color developments corresponding to resolved colors.

The original image is projected upon the photosensitive screen 12 through a first color resolving filter 58 to form a latent image on the screen, and as in the case of the copying machine shown in FIGS. 4 and 5, a sheet of copy paper P is attracted to and conveyed by the electrostatic attracting member 21 with respect to the surface of the latent image, thereby forming a primary electrostatic latent image on the surface of the copy paper (FIG. 21). Subsequently, during the rewind of the electrostatic attracting member 21, the copy paper P has the primary electrostatic latent image thereon developed by the first developing means 61. Such process is thereafter repeated with the color resolving filters 59, 60 and the developing means 62, 63 successively operated, whereby each resolved color image is superposed upon the same copy paper P, whereafter the separator pawl 64 separates the copy paper from the electrostatic attracting member 21 during the rewind thereof (FIG. 22), thus providing a colored copy. The developing means may be either of the dry type or of the wet (liquid) type, but where the dry type is employed, the dust image may partly be destroyed during the next development unless the fixing is effected by the use of pressure force or the like. In this regard, the wet type is convenient inasmuch as it only requires the excess developing liquid to be removed by a roller or like means. The color resolution is usually provided by three colors, or by four colors including black.

Thus, in the copying machine of the present invention, the photosensitive screen is constructed in a planar form and the copy paper P is generally intensely attracted to and conveyed by the electrostatic attracting member with respect to the surface of the planar screen, whereby reliable and accurate paper feed may readily be accomplished with a result that a good electrostatic latent image may be formed on the copy paper. Further, for colored copies to be produced, a predetermined relative position of the copy paper P and the photosensitive screen may be ensured during each resolved color copying by using a stop or like simple means to limit the amount of the electrostatic attracting member drawn toward the photosensitive screen, and this results in production of clear colored copies free of color misregistration. Furthermore, the photosensitive screen, which need neither be moved nor rotated like a drum-shaped screen, contributes to simplification and size-reduction of the copying machine construction and this in turn leads to the provision of a highly practical copying machine.

The screen as shown in FIG. 13 or other screen is also applicable in the apparatus shown in FIGS. 20–22. For example, where the screen of FIG. 13 is applied in the color copying machine of FIG. 20, a corona discharger for secondary voltage application and an overall irradiating lamp may be added as shown in the apparatus of FIG. 18. In the present invention, it should be noted that the construction of the screen as well as the process effected thereon and the type of the recording material are not restricted to those described in the foregoing embodiments.

We claim:

1. An electrostatic copying machine comprising:

a photosensitive screen having a number of fine openings therein;

means for exposing a surface of said screen to an original image at an image exposure position for forming on said screen a primary electrostatic latent image corresponding to an original image;

electrostatic attracting means for electrostatically attracting a recording material and conveying said material to a recording position adjacent said exposed surface of said photosensitive screen at said exposure position, after said formation of said primary electrostatic latent image;

means for supplying the recording material to said electrostatic attracting means; and means for forming a secondary electrostatic latent image on said recording material at said recording position.

2. An electrostatic copying machine comprising:

a substantially stationary photosensitive screen having a number of fine openings therein;

means for exposing a surface of said screen to image light to form a primary electrostatic latent image corresponding to an original image on said screen;

electrostatic attracting means for electrostatically attracting a recording material and conveying said material to a recording position opposing said surface of said screen after formation of said primary electrostatic latent image thereon;

means for supplying the recording material to said electrostatic attracting means; and means for forming a secondary electrostatic latent image on the recording material at said recording position.

3. An electrostatic copying machine according to claim 2, wherein said attracting means includes a reciprocating member for conveying said recording material to said recording position from a position adjacent said supply means.

4. An electrostatic copying machine according to claim 2, wherein said electrostatic attracting means includes back-tension reel means, and an electrostatic attracting member wound around said reel means for being unwound therefrom to move said recording material to said recording position, and for being subsequently rewound by the back-tension of the reel.

5. An electrostatic copying machine according to claim 2, wherein said attracting means includes an endless member, means for moving said endless member between a retracted position and said recording position, and means for rotating the endless member, wherein the recording material is conveyed by rotation of the endless member from said supply means to said recording position.

6. An electrostatic copying machine according to claim 2, wherein said electrostatic attracting means comprises an electrostatic attracting member including a high resistance layer having first and second conductive layers disposed on opposite sides thereof, and wherein said second conductive layer comprises a plurality of interconnected conductive projections extending from said high resistance layer, said electrostatic attracting member being effective to attract the recording material upon application of a voltage to said two conductive layers on the opposite sides of said high resistance member.

7. An electrostatic copying machine according to claim 6, wherein said second conductive layer of said electrostatic attracting member is in the form of a net.

8. An electrostatic copying machine according to claim 6, wherein said second conductive layer of said electrostatic attracting member is in the form of substantially equidistant lines.

9. An electrostatic copying machine comprising:

a substantially stationary photosensitive screen having a number of fine openings therein;

means for exposing a surface of said screen to image light to form a primary electrostatic latent image coresponding to an original image on said screen;

electrostatic attracting means for electrostatically attracting a recording material and conveying said material to a recording position opposing said surface of said screen after formation of said primary electrostatic latent image thereon, said attracting means including an endless attracting member and means for moving said member from a retracted position to said recording position;

means for supplying the recording material to said electrostatic attracting means; and means for forming a secondary electrostatic latent image on the recording material at said recording position.

10. An electrostatic copying machine comprising:

a substantially stationary photosensitive screen having a number of fine openings therein;

means for exposing a surface of said screen to image light to form a primary electrostatic latent image corresponding to an original image on said screen;

electrostatic attracting means for electrostatically attracting a recording material and conveying said material to a recording position opposing said surface of said screen after formation of said primary electrostatic latent image thereon, wherein said attracting means includes a flexible endless member, a stationary roller for stretching said endless member, and a movable roller for moving said endless member from a retracted position to said recording position;

means for supplying the recording material to said electrostatic attracting means; and means for forming a secondary electrostatic latent image on the recording material at said recording position.

11. An electrostatic copying machine comprising:

a photosensitive screen having a number of fine openings and including a conductive member, a photoconductive member provided on said conductive member, and a surface insulating member provided on said photoconductive member, said photoconductive and surface insulating members covering at least a substantial part of said conductive member;

means for exposing a surface of said screen to an original image at an image exposure position for forming a primary electrostatic latent image of an original on said screen, said primary image forming means including primary voltage applying means, secondary voltage applying means and an optical system for projecting therethrough an image of the original upon said screen;

electrostatic attracting means for electrostatically attracting a recording material and conveying said material to a recording position adjacent said exposed surface of said screen at said exposure position, after said formation of said primary electrostatic latent image;

means for supplying the recording material to said electrostatic attracting means; and means for forming a secondary electrostatic latent image on said recording material at said recording position.

12. An electrostatic copying machine comprising:

a substantially stationary photosensitive screen having a number of fine openings and including a conductive member, a photoconductive member provided on said conductive member, and a surface insulating member provided on said photoconductive member, said photoconductive and surface insulating members covering at least a substantial part of said conductive member;

means for exposing a surface of said screen to an original image for forming a primary electrostatic latent image of an original on said screen, said primary image forming means including primary voltage applying means, secondary voltage applying means and an optical system for projecting therethrough an image of the original upon said screen;

electrostatic attracting means for electrostatically attracting a recording material and conveying said material to a recording position adjacent said exposed surface of said screen after said formation of said primary electrostatic latent image;

means for supplying the recording material to said electrostatic attracting means; and means for forming a secondary electrostatic latent image on said recording material at said recording position.

13. An electrostatic copying machine according to claim 12, wherein said attracting means includes an endless member, means for moving said endless member between a retracted position and said recording position, and means for rotating the endless member, wherein the recording material is conveyed by rotation of the endless member from said supply means to said recording position.

14. An electrostatic copying machine according to claim 12, wherein said attracting means includes a reciprocating member for conveying said recording material to said recording position from a position adjacent said supply means.

15. An electrostatic copying machine according to claim 12, wherein said electrostatic attracting means includes back-tension reel means, and an electrostatic attracting member wound around said reel means for being unwound therefrom to move said recording material to said recording position, and for being subsequently rewound by the back-tension of the reel.

16. An electrostatic copying machine according to claim 12, wherein said electrostatic attracting means comprises an electrostatic attracting member including a high resistance layer having first and second conductive layers disposed on opposite sides thereof, and wherein said second conductive layer comprises a plurality of interconnected conductive projections extending from said high resistance layer, said electrostatic attracting member being effective to attract the recording material upon application of a voltage to said two conductive layers on the opposite sides of said high resistance member.

17. An electrostatic copying machine comprising:

a photosensitive screen having a number of fine openings therein;

means for exposing a surface of said screen to sequential color resolved portions of an original image at an image exposure position for sequentially forming on said screen a separate primary electrostatic latent image corresponding to each color resolved portion of the original image;

electrostatic attracting means for electrostatically attracting a recording material, wherein said attracting means conveys said material to a recording position adjacent said exposed surface of said photosensitive screen at said exposure position and then conveys said material away from said recording position, after each said formation of said separate primary electrostatic latent images;

means for supplying the recording material to said electrostatic attracting means;

means for forming a secondary electrostatic latent image on said recording material at said recording position, each time said material is conveyed thereto; and means for developing each secondary electrostatic latent image formed on said recording material with a color developer corresponding to a respective resolved color each time said attracting means conveys said material away from said recording position.

18. An electrostatic copying machine comprising:

a substantially stationary photosensitive screen having a number of fine openings therein;

means for exposing a surface of said screen to sequential color resolved portions of an original image for sequentially forming on said screen a separate primary electrostatic latent image corresponding to each color resolved portion of the original image;

electrostatic attracting means for electrostatically attracting a recording material, wherein said attracting means conveys said material to a recording position adjacent said exposed surface of said photosensitive screen and then conveys said material away from said recording position, after each said formation of said separate primary electrostatic latent images;

means for supplying the recording material to said electrostatic attracting means;

means for forming a secondary electrostatic latent image on said recording material at said recording position, each time said material is conveyed thereto; and means for developing each secondary electrostatic latent image formed on said recording material with a color developer corresponding to a respective resolved color each time said attracting means conveys said material away from said recording position.

19. An electrostatic copying machine according to claim 18, wherein said developing means and said recording material conveyed by said attracting means are moved relative to each other as each secondary electrostatic latent image is developed with a respective color developer by said developing means.

20. An electrostatic copying machine according to claim 18, wherein said electrostatic attracting means comprises an electrostatic attracting member including a high resistance layer having first and second conductive layers disposed on opposite sides thereof, and wherein said second conductive layer comprises a plurality of interconnected conductive projections extending from said high resistance layer, said electrostatic attracting member being effective to attract the recording material upon application of a voltage to said two conductive layers on the opposite sides of said high resistance member.

21. An electrostatic copying maching according to claim 18, wherein said attracting means includes a reciprocating member for conveying said recording material to said recording position from a position adjacent said supply means.

22. An electrostatic copying maching according to claim 18, wherein said electrostatic attracting means includes back-tension reel means, and an electrostatic attracting member wound around said reel means for being unwound therefrom to move said recording material to said recording position, and for being subsequently rewound by the back-tension of the reel.

* * * * *

UNITED STATES PATENT OFFICE

CERTIFICATE OF CORRECTION

Patent No. 3,936,177 Dated February 3, 1976

Inventor(s) INAO MORIYAMA, YUJIRO ANDO, KATSUNOBU OHARA, & KEIJI TANAKA

It is certified that error appears in the above-identified patent and that said Letters Patent are hereby corrected as shown below:

Column 1, line 36, change "process" to --processes--;

line 51, before "applied" insert --are--;

Column 3, line 10, change "material" to --materials--;

Column 4, lines 23 & 24, delete "photosensitive" and insert --original--;

line 35, delete "pehoto-" and insert --photo---;

line 42, delete the second "." after "20";

Column 6, line 23, change "discharge" (first occurrence) to --discharger-- and change "discharger" (second occurrence) to --discharge--;

line 36, change "displaaced" to --displaced--;

Column 7, line 58, change "secndary" to --secondary--;

Claim 22, line 38, change "maching" to --machine--.

Signed and Sealed this eighteenth Day of May 1976

[SEAL]

Attest:

RUTH C. MASON
*Attesting Officer*

C. MARSHALL DANN
*Commissioner of Patents and Trademarks*